US007583907B2

(12) United States Patent
Behnke et al.

(10) Patent No.: US 7,583,907 B2
(45) **Date of Patent: *Sep. 1, 2009**

(54) METHOD FOR ADJUSTING A FUSING DEVICE OF A DIGITAL PRINTING MACHINE BY DETERMINING THE HUMIDITY OF PRINTING MATERIAL AND MEASURING DEVICE TO DETECT THE REFLECTANCE OF MICROWAVE SIGNALS AT A PRINT MATERIAL

(75) Inventors: Knut Behnke, Flintbek (DE); Bernd Geck, Hannover (DE); Frank-Michael Morgenweck, Kiel (DE); Domingo Rohde, Kiel (DE); Lars Seimetz, Achterwehr (DE); Oliver Klemp, Hannover (DE)

(73) Assignee: Eastman Kodak Company, Rochester, NY (US)

( * ) Notice: Subject to any disclaimer, the term of this patent is extended or adjusted under 35 U.S.C. 154(b) by 26 days.

This patent is subject to a terminal disclaimer.

(21) Appl. No.: 10/586,982

(22) PCT Filed: Jan. 19, 2005

(86) PCT No.: PCT/EP2005/000487

§ 371 (c)(1),
(2), (4) Date: Apr. 20, 2007

(87) PCT Pub. No.: WO2005/071495

PCT Pub. Date: Aug. 4, 2005

(65) Prior Publication Data

US 2007/0292151 A1 Dec. 20, 2007

(30) Foreign Application Priority Data

Jan. 24, 2004 (DE) ..... 10 2004 004 329

(51) Int. Cl.
*G03G 15/00* (2006.01)

(52) U.S. Cl. ..... 399/45; 399/67

(58) Field of Classification Search ..... 399/45, 399/67

See application file for complete search history.

(56) References Cited

U.S. PATENT DOCUMENTS 4,511,778 A 4/1985 Takahashi et al.

(Continued)

FOREIGN PATENT DOCUMENTS

EP 1 211 504 A2 6/2002

*Primary Examiner*—David M Gray
*Assistant Examiner*—Bryan P Ready
(74) *Attorney, Agent, or Firm*—Lawrence P. Kessler; Eugene I. Shkurko

(57) ABSTRACT

It is an object of the present invention to provide a high-quality printed image in a printing machine. To achieve this, a method for adjusting a fusing device 100 of a digital printing machine has been provided, in which case microwave signals of a specific frequency or frequency range are directed at a printing material 5, a change between the microwave signals reflected by the printing material and the emitted microwave signals is detected, and in which case the fusing device is adjusted based on the change between said microwave signals. Furthermore, a measuring device 20 for a printing machine is provided, said device preferably being used for carrying out the said method, whereby the measuring device is configured so as to detect a change between a microwave signal reflected by the printing material 5 and a microwave signal directed at said printing material.

2 Claims, 2 Drawing Sheets

Figure 1:
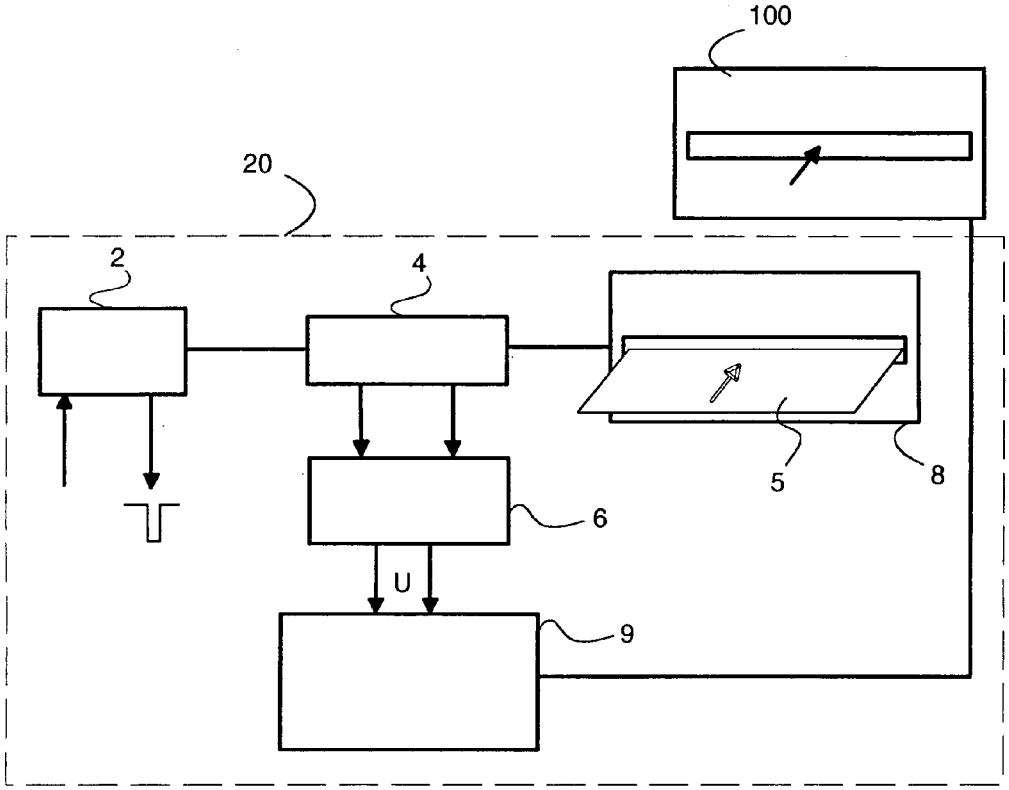

U.S. PATENT DOCUMENTS 4,542,980 A 9/1985 Tajima
5,369,368 A * 11/1994 Kassen et al. ..... 324/632
6,246,860 B1 * 6/2001 Ohmichi ..... 399/406
6,587,665 B2 7/2003 Bartscher et al.
6,591,083 B2 7/2003 Rohde
6,683,287 B2 1/2004 Behnke et al.
2004/0228643 A1 * 11/2004 Behnke et al. ..... 399/33

* cited by examiner

METHOD FOR ADJUSTING A FUSING DEVICE OF A DIGITAL PRINTING MACHINE BY DETERMINING THE HUMIDITY OF PRINTING MATERIAL AND MEASURING DEVICE TO DETECT THE REFLECTANCE OF MICROWAVE SIGNALS AT A PRINT MATERIAL

The present invention relates to a method in accordance with the preamble of Claim 1 and to a fusing device in accordance with the preamble of Claim 7.

In the field of printing machines, digital printing machines are gaining in importance. These machines use different types of printing material in rapid succession. A knowledge regarding the properties of the used printing materials is particularly important in the case of digital printing machines so as to be able to obtain a high-quality printed image. Some of the properties of printing materials are known before the printing operation; however, some of them are variable and hence not known. Variable properties of printing materials result in fluctuations of printing quality; i.e., ultimately, variable properties affect the printed image on the printing material.

It is an object of the present invention to provide a high-quality printed image in a printing machine.

In accordance with the present invention, this problem has been solved by the features of Claims 1 and 7.

To achieve this, a method for adjusting a fusing device of a digital printing machine has been provided, in which case microwave signals of a specific frequency or frequency range are directed at a printing material, a change between the microwave signals reflected by the printing material and the emitted microwave signals is detected, and in which case the fusing device is adjusted based on the change between said microwave signals. Furthermore, a measuring device for a printing machine is provided, said device preferably being used for carrying out the method in accordance with one of the previous claims, whereby the measuring device is configured so as to detect a change between a microwave signal reflected by the printing material and a microwave signal directed at said printing material. In this manner, the fusing device is adapted in a suitable manner to the printing material which is currently in the printing machine. By adjusting the fusing device, the printing result is improved and the risk of damage to the printing material due to a potentially erroneous adjustment of the fusing device is eliminated. The energy use of the fusing device is controlled efficiently because, at all times, only as much energy is provided as is required for fusing the toner to the printing material.

Embodiments of the present invention are disclosed by the subclaims.

In one embodiment of the invention, an easily measurable change in resonance frequency in the applicator loaded with printing material is detected as a function of the properties of the printing material. By changing the resonance frequency, conclusions may be drawn regarding the properties of the printing material.

In another embodiment of the invention, an easily measurable level change and a phase change of the emitted microwave signals compared with the reflected microwaves are detected.

Advantageously, the change of the microwave signal is used to determine printing material humidity. Printing material humidity is of particular importance regarding the fusing process, in particular if the fusing device is based on microwave technology.

In one embodiment, an applicator of the measuring device is pre-heated when the printing material is fed through. This measure reduces measuring errors that may potentially occur due to material changes of the applicator housing, said errors being due to external temperature influences. In this way, temperature fluctuations affect the length of the applicator housing and, hence, directly the resonance frequency in the applicator.

One development of the invention uses the change of the microwave signal to determine the type of printing material, specifically the GSM (Grams per Square Meter) of the printing material. In this way, it can be determined whether the wrong printing material is potentially being transported through the printing machine.

One embodiment of a fusing device, in particular a microwave fuser, discloses a sensor which measures the temperature of the printing material immediately after it leaves the fusing device, in which case the fusing device is set initially based on the frequency measurement. In this case, the fusion process is controlled by said temperature measurement. If the measured temperature of the printing material deviates significantly from the required fusing temperature, this allows the conclusion that the wrong printing material, e.g., a coated printing material instead of an uncoated printing material, is being processed. Based on the frequency measurement alone, this information relating to the printing material cannot be conveyed to the fusing device.

In an advantageous embodiment, the interior space of the applicator of the fusing device is provided, at least in part, with a dielectric material. By adding this feature, the dimensions of the applicator are restricted, as are the electrical losses in the applicator.

Advantageously, the applicator is made of aluminum, specifically of a standardized structured aluminum, which reduces manufacturing costs.

Figure 2:
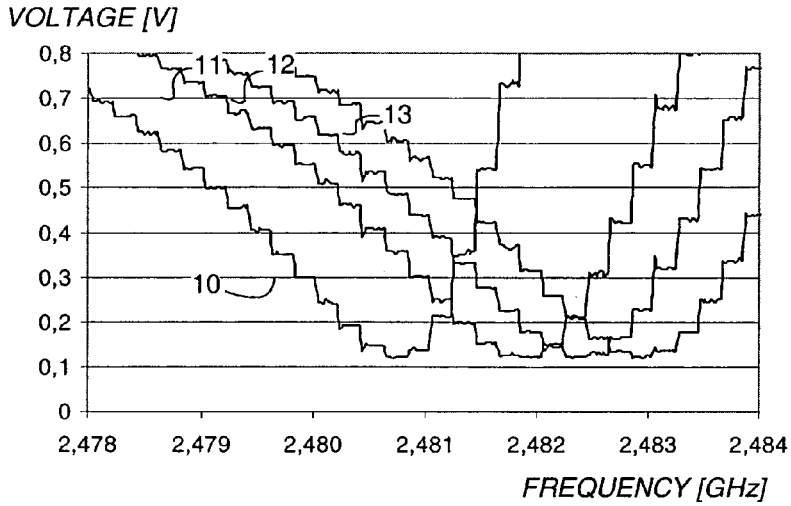
Figure 3:
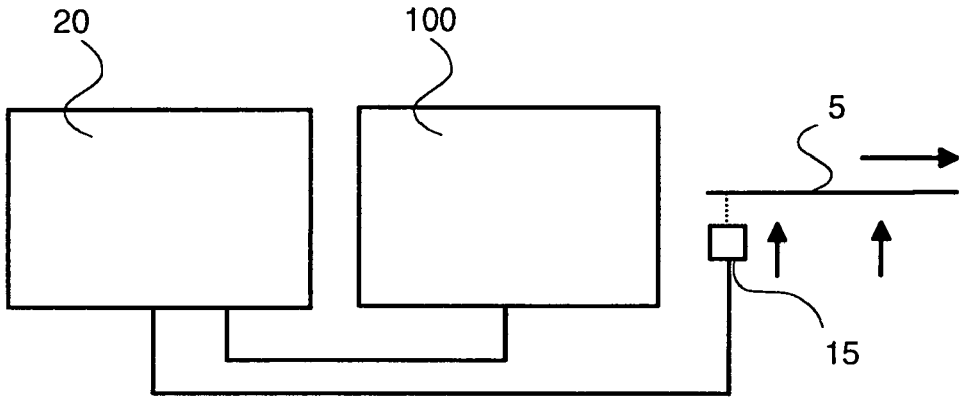

Following is a detailed description of one embodiment of the invention with reference to the drawings. They show:

FIG. 1 a schematic block diagram of a measuring device and a connected adjustable device for a digital printing machine;

FIG. 2 the operational sequences of voltage as a function of frequency for a specific printing material exhibiting different levels of humidity;

FIG. 3 a schematic block diagram of a modification of the invention comprising a measuring device, in which case, downstream of the measuring device, a first fusing device and a sensor are arranged, said sensor measuring the temperature of the printing material, and in which case the printing material is fed to a second fusing device.

FIG. 1 shows a schematic block diagram of a measuring device 20 for measuring the humidity of a printing material 5. Measuring device 20 comprises circuit blocks framed by the dashed line. A microwave generator 2 generates microwaves which, in the present example, are designed to determine the properties of printing material 5. Microwave generator 2, for example, is a microwave synthesizer which allows the highly accurate and chronologically highly stable adjustment of frequencies within the range of 2.2 to 2.6 GHz. Microwave generator 2 features a microwave output in the Milliwatt range. Via a switching network 4, microwave generator 2 is connected with an applicator 8 and inputs its high-frequency microwave signal in switching network 4. Printing material 5, which is to be measured, is passed through applicator 8. Applicator 8, for example a TE-10N, comprises a reflectance resonator which consists of commercially available standardized R26 waveguide material. Applicator 8 essentially consists of a closed housing, for example, of aluminum, preferably a standardized structured aluminum, in which a microwave field is created. As an alternative to the closed housing, applicator 8 comprises two parallel conductive plates, between which printing material 5 is passed, and in which case a microwave field is created between said plates. The interior space of applicator 8 of measuring device 20 is provided, at least in part, with a dielectric material. In order to feed printing material 5, the centers of the lateral surfaces of applicator 8 are provided with two centered slots each, said slots having a height in the range of 6 mm to 10 mm and a length of 400 mm. For example, printing material 5, is passed through applicator 8 and carried by a transport belt or an air cushion. Switching network 4 is designed to provide measuring parameters and consists of two serially connected directional couplers. A percentage proportional to the input signal is uncoupled from the signal that has been input by microwave generator 2 and is made available as a reference signal. The largest percentage of the signal reaches the measuring gate to which applicator 8 containing the microwave field is connected. The signal reflected by applicator 8 is transmitted back to switching network 4. A percentage proportional to the reflected microwave signal becomes available at the output of switching network 4. Consequently, a percentage of the signal, which moves from microwave generator 2 to switching network 4, and a percentage of the signal, which is reflected by printing material 5 in applicator 8 and returns to switching network 4, are available at the outputs of switching network 4. A vector voltmeter 6 is electrically connected with switching network 4 and is designed to produce the quotient of the signal fed to applicator 8 and the signal reflected from it, i.e., to produce a reflectance factor. An output voltage is generated in vector voltmeter 6, said voltage being proportional to the level difference between the incoming and the reflected microwave signal; and another output voltage is generated which is proportional to the extent of the phase difference between these two signals. The quotient of the measured voltages of the incoming microwave signal $U_{in}$ impinging on printing material 5 and the correspondingly reflected microwave signal $U_{reflected}$ expresses reflectance factor $r=U_{reflected}/U_{in}$. In so doing, the output voltages are measured with a DC voltmeter, an oscilloscope, or an A/D transducer map. The output voltages of vector voltmeter 6 are transmitted to a control device 9 of the printing machine. Following measuring device 20, viewed in transport direction, a fusing device 100 is arranged and connected with measuring device 20 which is energized based on the measurements for fusing toner to printing material 5, this representing the last step of the printing process.

FIG. 2 shows the operational sequences of a voltage on vector voltmeter 6 in Volts, which is plotted on the abscissa, as a function of a microwave frequency in Gigahertz, which is plotted on the abscissa. The measurements, with measuring device 20, either use a single microwave frequency or several microwave frequencies within a specific frequency range, which, preferably, comprises the resonance region, as described hereinafter. Four curves 10, 11, 12, 13 are shown, each representing the voltage at different moisture contents of printing material 5. In FIG. 2, the voltages delivered by vector voltmeter 6 are proportional to the microwave signal reflected by printing material 5 in applicator 8, whereby these voltages are a function of different factors such as, for example the humidity and the GSM of printing material 5. In so doing, printing material 5, considering the graphs of FIG. 2, exhibits a GSM of 135 g, for example, while the temperature in applicator 8 is maintained constant. The first curve 10 identifies a printing material 5 exhibiting a relative percentage of moisture of 20%; the second curve 11 identifies a printing material 5 exhibiting a relative percentage of moisture of 40%; the third curve 12 identifies a printing material 5 exhibiting a relative percentage of moisture of 60%; and the fourth curve 13 identifies a printing material 5 exhibiting a relative percentage of moisture of 80%. Due to the step width of the signals of microwave generator 2, curves 10, 11, 12 and 13 are stepped. It can be seen that each of the voltages of curves 10, 11, 12 and 13 drops to a minimum, and subsequently rises steeply. The minima in curves 10, 11, 12 and 13 each identify the resonance frequency, which, with increasing humidity of printing material 5, increases to higher values; for example, a printing material 5 exhibiting a percentage of moisture of 80% has a resonance frequency that is higher by 2 MHz than a printing material 5 exhibiting a percentage of moisture of 20%. In the case of the illustrated resonance frequencies, the resonance in applicator 8 occurs with the specific printing material 5; a change of printing material 5 results in a resonance frequency shift by a few Megahertz; in SO doing, the electrical adjustment in applicator 8 changes. Therefore, it follows that, when printing material 5 is subjected to a specific microwave frequency, the properties of printing material 5 can be deduced, i.e., specifically the moisture content of printing material 5. For example, if microwave generator 2 generates a frequency of approximately 2.4808 GHz and said frequency is applied to printing material 5, vector voltmeter 6 measures an output voltage of approximately 0.12 Volts. Based on this output voltage, with reference to the illustration of FIG. 2, it can be determined that printing material 5 exhibits a relative percentage of moisture of approximately 20%. To do so, control device 9 provides allocation tables which allocate a degree of moisture to the combination of an obtained microwave frequency and a measured voltage for a specific printing material 5. Considering this allocation, printing material 5 in control device 9 of the digital printing machine is known because each printing material 5 is entered or detected automatically when a changed printing job is run. By detecting the voltage, the humidity of printing material 5 in applicator 8 is determined. Each combination of a microwave frequency and a measured voltage as indicated by curves 10, 11, 12, 13 is unambiguously associated with a moisture content as a function of the used printing material 5.

When other printing materials 5 are in applicator 8, other operational sequences of the voltage as a function of the frequency are obtained. The operational sequences are a function of the type of printing material 5, for example the GSM, i.e., the mass in weight per unit area, or the coating of printing material 5. Each printing material 5 used in the printing machine can be associated with data stored in the allocation table, so that the properties of printing material 5, in particular its humidity, can be determined by means of the described measurements in the case of each printing material 5.

The thusly determined moisture content of printing material 5 is used to adjust a fusing device 100 downstream of measuring device 20 in such a manner that appropriate fusing of the toner to the specific printing material 5 may occur. The fusing parameters, which are set in fusing device 100 based on the measurements, represent essentially the fusing temperature or the power output. These parameters are adjusted in such a manner that a safe and appropriate fusion is achieved for each specific printing material 5 and each variable moisture content. To achieve this, control device 9 energizes fusing device 100 and changes at least one fusing parameter accordingly. For example, control device 9 controls a setting member in the applicator of fusing device 100, said setting member affecting the microwave field in the applicator and changing the energy acting on printing material 5. Furthermore, control device 9 uses the measured results in order to control the energy output to fixing device 100 and to adjust this energy output to the respectively present printing material 5.

Another application of the invention involves checking the printing material 5 present in applicator 8 of measuring device 20. This becomes possible because the quotient of the incoming signal and the reflected signal, i.e., the reflectance factor r, is highly dependent on the GSM of printing material 5. The GSM of the current printing material 5 allows the simple conclusion as to the type of printing material 5, because the GSM is a characteristic property of printing material 5. Consequently, a measured GSM is allocated to a given type of printing material 5 in control device 9. Therefore, with this particular application using the measuring device 20 as described above, it can be verified that the correct printing material 5 desired for a specific printing job moves through the printing machine and that errors occurring when the printing material container is loaded are detected when printing material 5 is fed to the printing machine.

FIG. 3 shows a schematic block diagram of a modification of the invention using measuring device 20 for sending microwave signals to a printing material 5, as in FIG. 1. Measuring device 20 is configured as described above; the components of the above-described measuring device 20 are not illustrated. Downstream of measuring device 20, viewed in transport direction, is a fusing device 100 which is connected with measuring device 20, in particular control device 9, and which, in this example, comprises a fusing device 100'. Fusing device 100 essentially applies heat to printing material 5 and thus fuses the toner to printing material 5. Furthermore, fusing device 100 may also apply mechanical pressure on printing material 5. For example, fusing device 100 is a microwave fusing device with applicators for the application of a microwave field to printing material 5 for fusing purposes. As described above, control device 9 transmits the results of the measurements to fusing device 100, which carries out the fusing process based on the measured results. As least one fusing parameter of the first fusing device 100 is adjusted based on the preceding measurement. Downstream of fusing device 100 a sensor 15 is provided which detects the temperature on the surface of printing material 5 as it leaves applicator 8 of measuring device 20 and the subsequent fusing device 100. After printing material 5 has left measuring device 20, fusing device 100 has been adjusted appropriately for fusing the current printing material 5. Inasmuch as, however, some features can have the effect that fusing device 100 cannot be adjusted appropriately, for example, a coating of printing material 5, the temperature parameter is additionally used to adjust fusing device 100. The temperature measured by sensor 15 is transmitted to control device 9 which checks whether the temperature on the surface of printing material 5 after the first fusing step in fusing device 100 corresponds to the expected temperature as stored in control device 9. To do so, the measured temperature is compared with values from a temperature table stored in control device 9. In cases, in which a coating of printing material 5 could potentially falsify the adjustment of fusing device 100, thus generating an inappropriate microwave field for fusion in fusing device 100, control device 9 will perform an appropriate correction for each subsequent printing materials or the operator will be prompted to check the fed printing material.

The invention claimed is:

1. Method for adjusting a fusing device (100) of a digital printing machine, comprising the steps of:

providing microwave signals of a specific frequency range directed at a printing material (5), with an applicator (8) of a measuring device (20) being pre-heated for feed-through of the printing material (5) such that a change between the microwave signals reflected by the printing material (5) and the emitted microwave signals is detected, using the microwave signals reflected by the printing material (5) to determine the humidity of the printing material (5), and wherein the microwave signals reflected by the printing material (5) are used to determine the type of printing material (5), specifically its mass in weight per unit area (Grams per Square Meter=GSM), and adjusting the fusing device (100) based on the change of said microwave signals.

2. Method as in claim 1, wherein toner is fused to the printing material (5) in the fusing device (100), a sensor (15) measures the temperature of the printing material (5), and the fusing result based on the sensor's measurement is evaluated.

* * * * *